US006735791B1

(12) United States Patent
Lordahl et al.

(10) Patent No.: US 6,735,791 B1
(45) Date of Patent: May 18, 2004

(54) DISPOSAL ADAPTER

(75) Inventors: Var Lordahl, 1571 Schaeffer, Long Grove, IL (US) 60047; Scott H. Koepsel, Winthrop Harbor, IL (US)

(73) Assignee: Var Lordahl, Long Grove, IL (US)

( * ) Notice: Subject to any disclaimer, the term of this patent is extended or adjusted under 35 U.S.C. 154(b) by 0 days.

(21) Appl. No.: 10/163,904

(22) Filed: Jun. 6, 2002

(51) Int. Cl.[7] ..... E03C 1/26
(52) U.S. Cl. ..... 4/292; 4/286
(58) Field of Search ..... 4/286–293, 295, 4/DIG. 4

(56) References Cited

U.S. PATENT DOCUMENTS 2,793,337 A * 5/1957 Ewing ..... 241/46.016
3,181,801 A * 5/1965 Lung et al. ..... 241/46.015
3,727,763 A * 4/1973 Arenskov ..... 210/163
5,265,281 A * 11/1993 McAlpine ..... 4/287
5,535,455 A * 7/1996 Liu ..... 4/287
5,560,052 A * 10/1996 Ferguson et al. ..... 4/650
5,662,138 A * 9/1997 Wang ..... 137/433

* cited by examiner

*Primary Examiner*—Gregory L. Huson
*Assistant Examiner*—Huyen Le
(74) *Attorney, Agent, or Firm*—Kajane McManus

(57) ABSTRACT

The disposal adapter comprises a seating ring, which when appropriately seated and fixed within a neck of a larger sink flange of a disposal, allows for engagement thereto of a smaller splash guard, eliminating the need to disassemble the IN-SINK-ERATOR disposal unit with the large sink flange for replacement of the splash guard thereof.

5 Claims, 2 Drawing Sheets

DISPOSAL ADAPTER

BACKGROUND OF THE INVENTION

1. Field of the Invention

The present invention relates to an adapter for use in adapting an easily replaceable rubber gasket or splash guard of one disposal embodiment for accommodation in another disposal embodiment.

2. Prior Art

Ninety percent of the garbage disposal market is covered by two manufacturers. The largest selling disposal is sold under the mark IN-SINK-ERATOR sold by Emerson Electric Company, St. Louis, Mo. (herein referred to as IN-SINK-ERATOR). The next largest selling disposal is sold under the mark WHIRLAWAY sold by White Consolidated, Cleveland, Ohio (hereinafter referred to as WHIRLAWAY).

Heretofore, when the rubber gasket or splash guard of an IN-SINK-ERATOR disposal unit becomes worn out, it has been necessary to disassemble the plumbing and the disposal unit for replacing the gasket, the gasket of this embodiment not only serving as a splash guard but also as a seal between a sink flange and a body of the disposal unit.

On the other hand, the WHIRLAWAY embodiment includes a drop in splash guard which is merely pushed into the neck of the sink flange from above. However, the splash guard of the WHIRLAWAY embodiment is of a diameter smaller than the sink flange of the IN-SINK-ERATOR, thus being incapable of being fixed in position within the sink flange of the IN-SINK-ERATOR embodiment.

As will be described in greater detail below, the disposal adapter of the present invention eliminates the need to take the IN-SINK-ERATOR embodiment apart, by accommodating fixing of the easily replaceable rubber gasket or splash guard and top plug from the WHIRLAWAY embodiment, sold by White Consolidated, Cleveland, Ohio, within the sink flange neck of the IN-SINK-ERATOR embodiment.

SUMMARY OF THE INVENTION

According to the invention there is provided an adapter for use in adapting a drop in splash guard to fit into a sink flange neck of a disposal unit which is larger than the splash guard to ensure a snug fit therein; the adapter comprising a seating ring within which the splash guard is secured, with the seating ring being sized to snugly be retained in an appropriate position within the larger sink flange neck.

DESCRIPTION OF THE PREFERRED EMBODIMENTS

Figure 1:
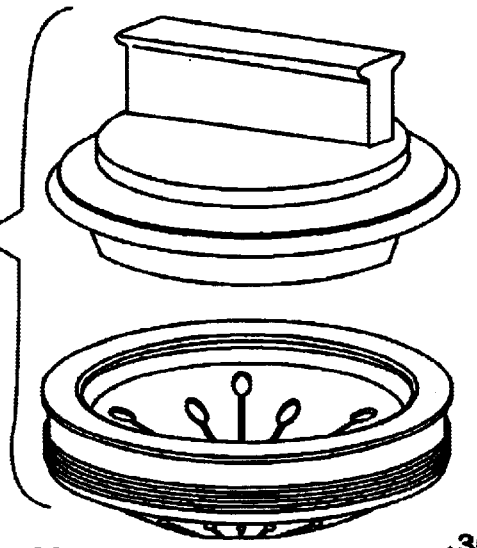
FIG. 1 PRIOR ART
FIG. 1 is an exploded perspective view of a prior art splash guard and cover of a disposal unit made and sold under the mark WHIRLAWAY.
Figure 3:
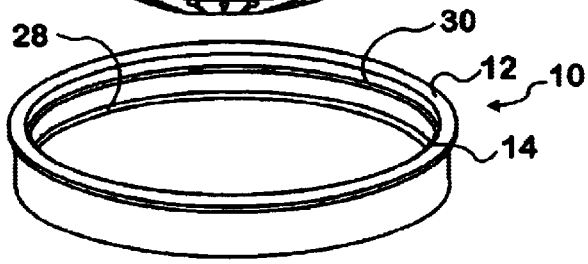
FIG. 3 is a perspective view of the adapter of the present invention.

Referring now to the drawings in greater detail, there is illustrated therein a disposal adapter 10 made in accordance with the teachings of the present invention.

Figure 2:
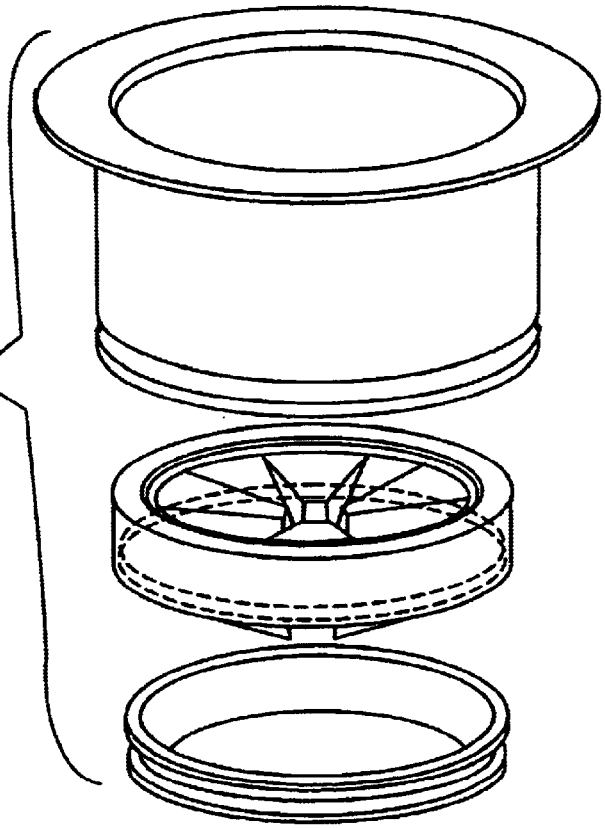
FIG. 2 PRIOR ART
FIG. 2 is a perspective view of a prior art sink flange, rubber gasket and mounting flange of a disposal unit sold under the mark IN-SINK-ERATOR.
Figure 4:
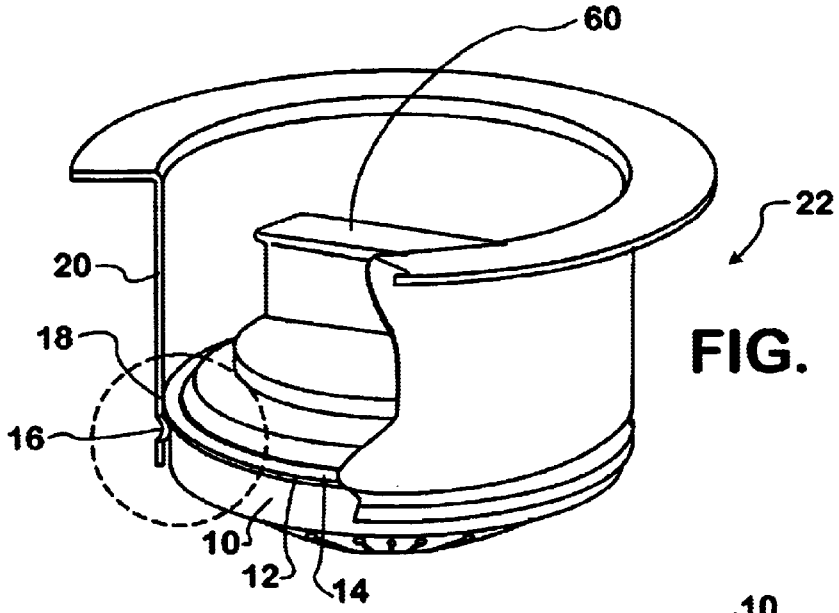
FIG. 4 is a perspective view of a sink flange of the IN-SINK-ERATOR disposal unit with a portion thereof broken away to show the adapter in use in engaging the WHIRLAWAY splash guard and cover therein.
Figure 5:
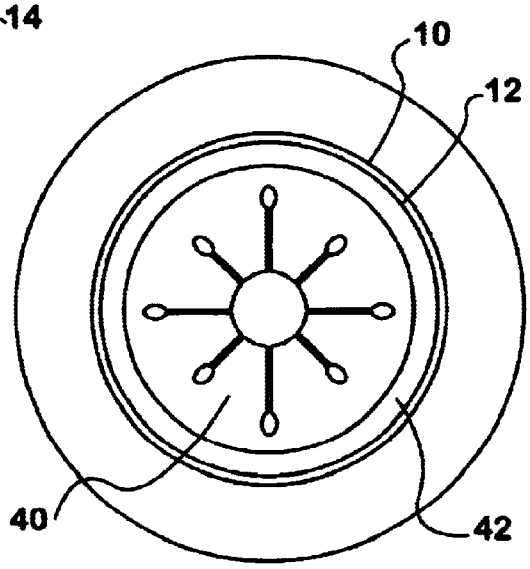
FIG. 5 is a top view looking into the sink flange showing the adapter engaging the WHIRLAWAY splash guard therein.

As is known in the art and illustrated in FIG. 2, a disposal typically is provided with a sink flange having a neck which depends therefrom to a point beneath a sink (not shown). Positioned beneath the sink flange is a rubber washer having "fingers" or inwardly directed flanges of an IN-SINK-ERATOR embodiment of a disposal thereon, which engages a mounting flange of the disposal unit. The mounting flange engages to the sink flange in known manner, with plumbing and electrical connections for the disposal then being connected appropriately for function of the disposal.

It is known that the IN-SINK-ERATOR rubber gasket or splash guard, provided for keeping fingers of a user and the like from coming into contact with grinding blades of the disposal, for keeping splashing from the disposal to a minimum, and for sealing the joint between the mounting flange and the sink flange, tends to wear out after a period of use.

Replacement of the IN-SINK-ERATOR rubber gasket has heretofore required complete disassembly of plumbing and the disposal, together with an intense struggle to remove the gasket from the flange over which it is engaged.

Turning now to FIG. 1, as described above, the WHIRLAWAY embodiment of a disposal unit incorporates a drop in splash guard, which if desired, may be used with a cover or cap therefor.

However, as stated above, the WHIRLAWAY disposal splash guard is not snugly accommodated within the larger sink flange neck of the IN-SINK-ERATOR disposal unit.

Thus the need for the adapter 10 of the present invention as illustrated in FIGS. 3–6, which adapts the WHIRLAWAY splash guard for use in the IN-SINK-ERATOR disposal unit.

As will be described hereinbelow, the disposal adapter 10 of the present invention eliminates the need for disassembly of the IN-SINK-ERATOR embodiment for replacement of the splash guard thereof. Rather, it provides a means for placing a second splash guard thereover without requiring removal of the original.

Perusing the Figures, it will be seen that the adapter 10 comprises a seating ring 10 having an outwardly extending top flange 12 along a top surface 14 thereof which engages over an inwardly directed circumferential rib 16 on a bottom area 18 of a neck 20 of an IN-SINK-ERATOR sink flange 22, the rib 16 limiting the downward extent to which the adapter 10 can be inserted by coacting with the top flange 12 thereof.

In installing the adapter 10, it will be obvious that no need exists to disassemble anything.

Figure 6:
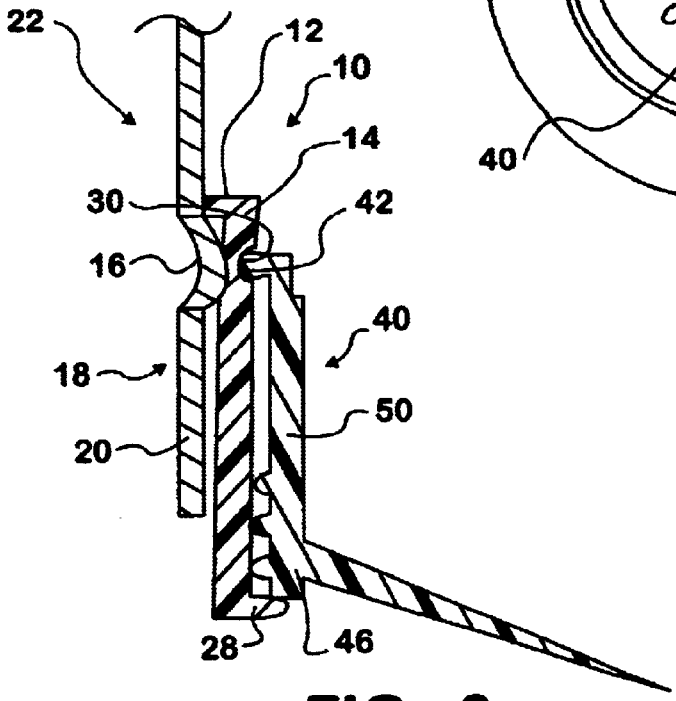
FIG. 6 is a cross sectional view showing the IN-SINK-ERATOR sink flange with the adapter and WHIRLAWAY splash guard engaged together and accommodated in the neck of the sink flange.

As best illustrated in FIG. 6, the adapter 10 further includes a bottom inwardly extending flange 28 along the circumference thereof, as well as an inner circumferential groove 30 adjacent the top surface 14 thereof.

Once the adapter 10 is pushed into the neck 20 of the sink flange 22 to a position where the exterior flange 12 of the adapter 10 rests upon the interior rib 16 of the sink flange neck 20, the gasket or splash guard 40 is pushed into the adapter 10 until a top flange 42 thereof snaps into and seats within the inner circumferential groove 30 of the adapter 10, with the inwardly directed bottom flange 28 of the adapter 10 engaging against a bottom edge 46 of the gasket sidewall 50, limiting the downward extent to which the gasket 40 can be pushed.

In this manner, the gasket 40 of one disposal embodiment, smaller in size than the larger sink flange neck 20 of another disposal embodiment, can be snugly secured within the larger sink flange neck 20, eliminating the need to disassemble the disposal unit with the larger sink flange neck 20.

One merely seats the seating ring 10 within the neck 20 of the sink flange 22, and presses the smaller gasket 40 into position within seating ring 10 until the outwardly directed top flange 42 thereof engages within the inner peripheral groove 30 of the ring 10 using the cover 60 to press the structures into the appropriate position, within the flange neck 20, as described above.

Removal and replacement is also simplified when necessary because the seating ring 10 and splash guard 40 engaged thereto are easily removed upwardly out of the sink flange 22, and then replaced as described above, with, again, no need to disassemble anything.

As described above, the adapter 10 of the present invention provides a number of advantages, some of which have been described above and others of which are inherent in the invention.

Also, modifications may be proposed to the adapter 10, as well as equivalents, without departing from the teachings of the present invention.

Accordingly, the scope of the invention is only to be limited as necessary by the accompanying claims.

What is claimed is:

1. An adapter for use in adapting a drop in splash guard of a first embodiment of a disposal unit to fit into a sink flange neck of a second embodiment of a disposal unit which is larger than the splash guard to ensure a snug fit therein; the adapter comprising a seating ring within which the splash guard is secured, with the seating ring being sized to snugly be retained in an appropriate position within the larger sink neck flange of the second embodiment of the disposal unit, eliminating the need to disassemble the second embodiment for replacement of a worn splash guard thereof, the splash guard with adapter seating over the worn splash guard.

2. The adapter of claim 1 having a top flange which extends outwardly therefrom and the sink flange neck having an internal circumferential rib upon which the external flange of the ring rests.

3. The adapter of claim 1 having a circumferential inner groove therein adjacent and below the top flange and the splash guard having an external flange, the external flange of the splash guard engaging within the groove of the adapter in a snap fit manner.

4. The adapter of claim 1 having a bottom inwardly extending flange and the splash guard having a sidewall having a bottom edge, the internally extending flange of the adapter engaging against the bottom edge of the splash guard to limit downward motion thereof within the adapter.

5. The adapter of claim 1, in conjunction with the splash guard, being appropriately positioned within the larger sink neck flange through application of pressure against a cover of the splash guard.

* * * * *